US008746262B2

(12) United States Patent
Disch et al.

(10) Patent No.: US 8,746,262 B2
(45) Date of Patent: Jun. 10, 2014

(54) CONVEYOR DISHWASHER AND METHOD FOR OPERATING A CONVEYOR DISHWASHER

(75) Inventors: Harald Disch, Elzach (DE); Martin Schrempp, Gengenbach (DE)

(73) Assignee: Premark FEG LLC, Glenview, IL (US)

( * ) Notice: Subject to any disclaimer, the term of this patent is extended or adjusted under 35 U.S.C. 154(b) by 516 days.

(21) Appl. No.: 13/058,204

(22) PCT Filed: Jul. 29, 2009

(86) PCT No.: PCT/US2009/052022
§ 371 (c)(1),
(2), (4) Date: Feb. 9, 2011

(87) PCT Pub. No.: WO2010/019380
PCT Pub. Date: Feb. 18, 2010

(65) Prior Publication Data

US 2011/0139186 A1 Jun. 16, 2011

(30) Foreign Application Priority Data

Aug. 11, 2008 (DE) ..... 10 2008 037 344

(51) Int. Cl.
*B08B 3/00* (2006.01)

(52) U.S. Cl.
USPC ..... 134/131; 134/56 D; 134/57 D; 134/58 D

(58) Field of Classification Search
CPC ..... A47L 15/0047; A47L 15/245; A47L 2401/04; A47L 2401/28; A47L 2501/03
See application file for complete search history.

(56) References Cited

U.S. PATENT DOCUMENTS

| | | | |
|---|---|---|---|
| 5,876,515 | A | 3/1999 | Värpiö |
| 2006/0213543 | A1 | 9/2006 | Litterst et al. |
| 2007/0034240 | A1 | 2/2007 | Berner et al. |
| 2008/0029131 | A1 | 2/2008 | Ecker |

FOREIGN PATENT DOCUMENTS

| | | |
|---|---|---|
| AT | 254453 | 5/1967 |
| CN | 1972624 | 5/2005 |
| DE | 19608030 | 7/1997 |
| DE | 19608036 | 7/1997 |
| DE | 69525337 | 3/2003 |
| DE | 102005021101 | 5/2006 |

(Continued)

OTHER PUBLICATIONS

PCT, International Search Report and Written Opinion, International Application No. PCT/US2009/052022 (Sep. 15, 2009).

(Continued)

*Primary Examiner* — Eric Golightly
(74) *Attorney, Agent, or Firm* — Thompson Hine LLP

(57) ABSTRACT

The invention relates to a conveyor dishwasher (2) comprising a conveyor apparatus (4) for conveying washware (6) through a final rinse zone (18), with the conveyor apparatus (4) having a large number of compartments (38) for accommodating washware (6). A washware sensor apparatus (42) is provided in order to detect empty compartments (38). In order to be able to reduce the consumption of fresh water, chemicals and energy during operation of the conveyor dishwasher (2), the invention provides a control apparatus (44) which is designed to automatically set the quantity of final rinse liquid supplied to the spray nozzles (20, 22, 24) of the final rinse zone (18) per unit time as a function of the detection of empty compartments (38). The invention also relates to a method for operating a conveyor dishwasher (2) of this type.

14 Claims, 3 Drawing Sheets

(56) References Cited

FOREIGN PATENT DOCUMENTS

| | | |
|---|---|---|
| DE | 102005004300 | 8/2006 |
| DE | 102005014353 | 9/2006 |
| DE | 102008014318 | 9/2009 |
| WO | 2006/081914 | 8/2006 |
| WO | 2009/114346 | 9/2009 |

OTHER PUBLICATIONS

Germany, Search Report, German Application No. 10 2008 037 344.3 (Dec. 9, 2008).

PCT, International Preliminary Report on Patentability, International Application No. PCT/US2009/052022 (Feb. 24, 2011).

CONVEYOR DISHWASHER AND METHOD FOR OPERATING A CONVEYOR DISHWASHER

The invention relates to a conveyor dishwasher and to a method for operating a conveyor dishwasher.

Accordingly, the invention relates, in particular, to a flight-type dishwasher (flight-type warewasher) or a rack conveyor dishwasher (rack conveyor warewasher) and to a method for operating a conveyor dishwasher of this type.

Conveyor dishwashers (conveyor warewashers) are used in the commercial sector. In contrast to domestic dishwashers, in which the washware to be cleaned remains stationary in the machine during cleaning, in conveyor dishwashers the washware is conveyed through various treatment zones of the conveyor dishwasher. A conveyor apparatus which generally has compartments for accommodating washware is used to convey washware in a conveying direction through the conveyor dishwasher. In the case of a flight-type dishwasher, the compartments can be formed by supporting fingers on a conveyor belt of the conveyor apparatus. In the case of rack conveyor dishwashers, dish racks in which compartments can be formed in order to accommodate the washware to be treated serve as the conveyor apparatus. It is feasible here for the dish racks to be conveyed through the rack conveyor dishwasher by a conveying device.

Document DE 10 2005 014 353 A1 describes a conveyor dishwasher which has a final rinse zone with both upper and lower spray nozzles and also lateral spray nozzles. A sensor apparatus for identifying washware is also provided. The supply of final rinse liquid to the lateral spray nozzles is switched on or switched off as a function of detected empty compartments, in order to thus be able to reduce the quantity of final rinse liquid sprayed in the final rinse zone per unit time.

German Patent Application DE 10 2008 014 381 discloses a conveyor dishwasher which has at least one wash zone and at least one final rinse zone. With the aim of being able to provide good treatment results for all the types of washware which are to be treated in the conveyor dishwasher in spite of reducing the consumption of fresh water, chemicals and energy during operation, DE 10 2008 014 318 proposes providing a washware detector apparatus for automatically detecting the type of washware to be treated, with a suitable treatment program being automatically selected for each detected type of washware and the process parameters which are associated with the selected treatment program being set. Using this approach, the type of washware is determined on the basis of the size, the shape and/or the material of the washware to be treated in the conveyor dishwasher.

Document DE 196 08 030 C1 relates to a conveyor dishwasher in which the length of an action section within a treatment zone can be set as a function of the load of washware by it being possible to switch on or switch off parts of the existing spray systems.

Document DE 10 2005 021 101 A1 relates to a conveyor dishwasher in which the final rinse zone has two spray arms which are formed separately from one another. One of the two spray arms is switched on or switched off either as a function of the conveying speed or as a function of the type, the quantity and the degree of soiling of the washware.

DE 695 25 337 T2 discloses a washing system through which articles to be washed are conveyed. A sensor for detecting the presence of articles to be washed is provided. If no articles are present, operation of the washing system is interrupted until an article to be washed passes the sensor again.

Accordingly, the prior art already generally discloses stopping final rinsing in conveyor dishwashers, for example in order to reduce the consumption of fresh water, when no washware enters the final rinse zone. However, the known solutions have the disadvantage that the period of time for which final rinsing is stopped cannot be selected to be as short as desired. In fact, up until now stopping of final rinsing has been considered only when no washware enters the final rinse zone for a certain time period. Care should be taken here that—once final rinsing is stopped—a certain lead time has to be allowed for reactivation of final rinsing until the jets of spray fan out satisfactorily and therefore effective treatment of the washware in the final rinse zone can be guaranteed.

Experiments have shown that a lead time of more than 4 seconds is required in conventionally used conveyor dishwashers in order to reactivate final rinsing when the final rinse system has been switched off for a period of 5 seconds. This lead time increases to approximately 7 seconds when the final rinse system has been switched off for a total of 10 seconds.

Accordingly, the approaches known from the prior art permit final rinsing to be switched off when it is possible that no washware will enter the final rinse zone for a relatively long period of time.

The invention is aimed at solving the problem of developing a conveyor dishwasher of the type mentioned in the introduction such that—compared to the conveyor dishwashers known from the prior art—the consumption of fresh water, chemicals and energy can be further reduced during operation. A particular aim is to specify a solution which permits the quantity of the final rinse liquid which is sprayed in the final rinse zone for final rinse purposes to also be effectively reduced when only single empty compartments or a group of only a few successive empty compartments enter the final rinse zone. A further aim is to specify a method for operating a conveyor dishwasher of this type.

The consumption of the fresh water, which is sprayed onto the washware in the final rinse zone in pure form or with further additives added, can be significantly reduced during operation of the conveyor dishwasher firstly by the provision of a washware sensor apparatus, with which the presence of empty compartments from amongst the large number of compartments of the conveyor apparatus is detected, and secondly by the provision of a control apparatus, with which the quantity of final rinse liquid supplied to the spray nozzles of the final rinse zone per unit time is automatically set as a function of whether empty or occupied compartments are present and enter the final rinse zone. It should be noted in particular here that, according to the invention, the volumetric flow of final rinse liquid is changed as empty compartments enter the final rinse zone.

This makes it possible to reduce the quantity of final rinse liquid supplied to the spray nozzles of the final rinse zone per unit time, without completely switching off final rinsing, in a case when, for example, only one single empty compartment or a group of only a few successive empty compartments enters the final rinse zone. Since final rinsing is performed with a reduced quantity of final rinse liquid, the consumption of fresh water can also be reduced when a single empty compartment is identified or at least when a group of a few successive empty compartments is identified.

Accordingly, the solution according to the invention permits the volumetric flow of the final rinse liquid to also be correspondingly changed as a function of the number of immediately successive empty compartments.

In one possible implementation of the conveyor dishwasher according to the invention, it is feasible for a total of three different values to be selected and set by the control apparatus for the quantity of final rinse liquid sprayed in the at least one final rinse zone per unit time, with the quantity of final rinse liquid sprayed per unit time assuming a predefined or predefinable (e.g., user or service person defineable or changeable via an interface) maximum value when at least one compartment which is occupied by washware enters the final rinse zone, the quantity of final rinse liquid sprayed per unit time assuming a predefined or predefinable reduced value when a single empty compartment or a group of a few, for example two or for example three, successive empty compartments enters the final rinse zone, and with the quantity of final rinse liquid sprayed per unit time assuming the value zero when a group of several, for example more than two or for example more than three, successive empty compartments enter the final rinse zone. It goes without saying that the critical number of successive empty compartments, starting from which the quantity of final rinse liquid sprayed per unit time assumes the value zero, is predefined or predefinable.

However, in a particularly preferred implementation of the solution according to the invention, provision is made for the control apparatus to be designed to set the quantity of final rinse liquid sprayed per unit time to different predefined or predefinable reduced values as a function of the number of successive empty compartments, in order to match final rinsing to the actual occurrence of washware as accurately as possible. It is therefore feasible, for example, for the quantity of final rinse liquid sprayed per unit time to be only slightly reduced when, for example, a single empty compartment enters the final rinse zone, whereas a greater reduction in the quantity of final rinse liquid sprayed per unit time is carried out when, for example, two successive empty compartments enter the final rinse zone, with the volumetric flow of final rinse liquid once again being reduced when, for example, three successive empty compartments enter the final rinse zone, etc. It can be seen that this reduction, which is dependent on the number of successive empty compartments, in the quantity of final rinse liquid sprayed in the final rinse zone per unit time can be predefined. It goes without saying that, even in this embodiment, the critical number of successive empty compartments, starting from which the quantity of final rinse liquid sprayed per unit time is further reduced, is also predefined or predefinable.

On account of the fact that, according to the invention, the quantity of final rinse liquid supplied to the spray nozzles of the final rinse zone per unit time is reduced as empty compartments enter the final rinse zone, it can be ensured that, in the supply line system via which final rinse liquid is supplied to the spray nozzles of the final rinse zone, the pressure cannot fall as severely as would be the case if final rinsing were completely stopped. The quantity of final rinse liquid supplied to the spray nozzles per unit time can therefore be increased again to a predefined (maximum) value considerably more quickly when, for example, it is identified that compartments occupied with washware enter the final rinse zone. In this case, the spray jets can fan out satisfactorily almost immediately after the identification of occupied compartments.

The reduced consumption of fresh water by the conveyor dishwasher can also reduce the consumption of chemicals, in particular rinse aid and/or detergent, without changing the chemical concentration in the respective liquid. The lower the supply of fresh water, the lower the quantity of water to be heated, as a result of which energy is saved.

The method according to the invention is a solution for operating a conveyor dishwasher, it being possible to reduce the consumption of, in particular, fresh water in a manner which is particularly easy to implement, but is nevertheless effective, during operation of a conveyor dishwasher.

The invention will be described in the text which follows with reference to the drawings using preferred embodiments as examples.

Figure 4:
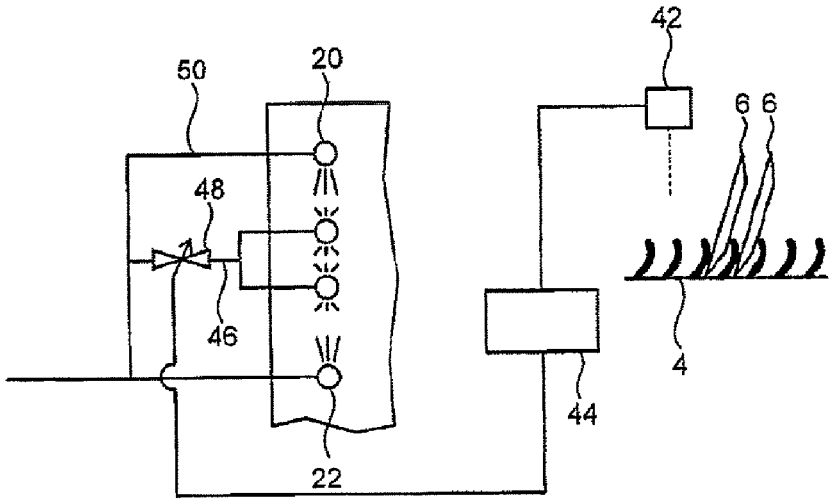
Figure 5:
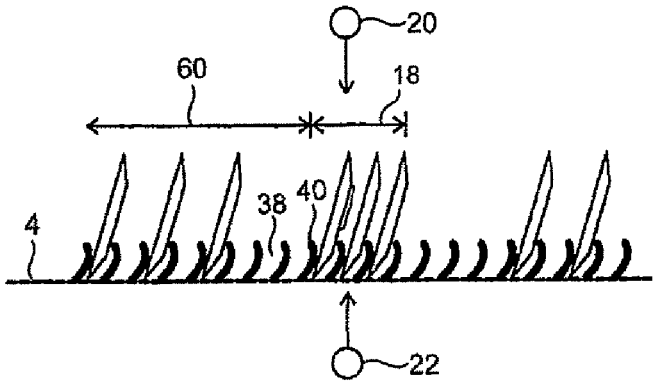

FIG. 4 schematically shows part of a conveyor dishwasher according to the invention; and FIG. 5 shows a conveying apparatus of one embodiment of a conveyor dishwasher according to the invention with items to be washed arranged on it.

Figure 1:
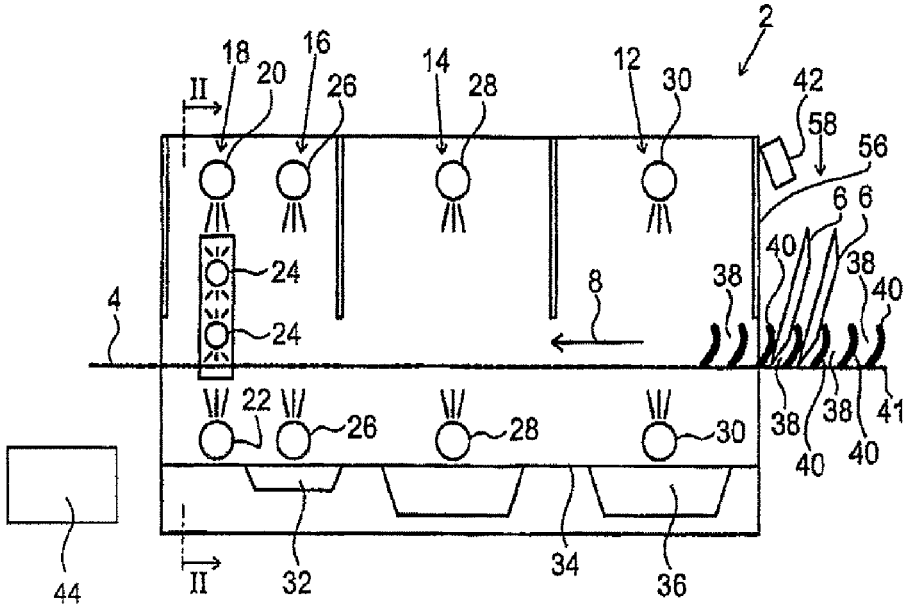
FIG. 1 is a view of a longitudinal section through a conveyor dishwasher according to the invention.

FIG. 1 shows a conveyor dishwasher 2 having a conveying apparatus 4 for conveying washware 6 through a housing of the conveyor dishwasher 2 in a conveying direction 8. The conveyor dishwasher 2 has at least one wash zone, for example as illustrated in FIG. 1, a prewash zone 12 and a main wash zone 14 which is arranged downstream of the prewash zone 12 as seen in the conveying direction 8.

A postwash zone 16 is arranged downstream of the at least one wash zone 12, 14 as seen in the conveying direction 8. At least one, for example as illustrated only a single, final rinse zone 18 is arranged downstream of the postwash zone 16 as seen in the conveying direction 8.

The treatment zones 12, 14, 16, 18 of the conveyor dishwasher 2 have associated spray nozzles 20, 22, 24, 26, 28, 30. These spray nozzles 20, 22, 24, 26, 28, 30 serve to spray liquid onto the washware 6 when it is conveyed through the respective treatment zones 12, 14, 16, 18 by the conveying apparatus 4. Each of the treatment zones 12, 14, 16, 18 has an associated tank 32, 34, 36 for collecting liquid which has been sprayed and/or for providing liquid for the spray nozzles 26, 28, 30 of the relevant treatment zones 12, 4, 16.

In the case of the conveyor dishwasher 2 illustrated in FIG. 1, final rinse liquid in the form of fresh water, which can be pure or admixed with further additives such as rinse aid, is sprayed onto the washware 6 by means of the spray nozzles 20, 22, 24 of the final rinse zone 18.

The final rinse liquid which has been sprayed is conveyed from treatment zone to treatment zone via a cascade system in the opposite direction to the conveying direction 8 of the washware 6.

The final rinse liquid which has been sprayed is collected in the tank of the postwash zone 16 (postwash tank 32) and from here it is delivered to the spray nozzles 26 of the postwash zone 16 via a pump system (not illustrated). Wash liquid is rinsed off from the washware 6 in the postwash zone 16. The liquid produced as a result of this flows into the tank of the main-wash zone 14 (main-wash tank 34), detergent is added and the resulting liquid is sprayed onto the washware 6 through a pump system (not illustrated) by means of the nozzles 28 of the main-wash zone 14. Liquid flows into the tank 36 of the prewash zone 12 (prewash tank 36) from the main-wash tank 34. The liquid in the prewash tank 36 is sprayed onto the washware 6 via a pump system (not illustrated) by means of the nozzles 30 of the prewash zone 12 in order to remove heavy soiling from the washware 6.

In the embodiments of the conveyor dishwasher 2 according to the invention which are illustrated in the figures, the conveyor apparatus 4 has compartments 38 which extend transverse to the conveying direction 8. These compartments 38 serve—as can be seen in particular in the illustration according to FIG. 5 for example—to accommodate washware 6. In the illustrated exemplary embodiments of a conveyor dishwasher 2, the compartments 38 are formed by supporting fingers 40 on a conveyor belt 41 of the conveyor apparatus 4. As an alternative, the compartments 38 can be formed, for example, in dish racks in a rack conveyor dishwasher.

Figure 2:
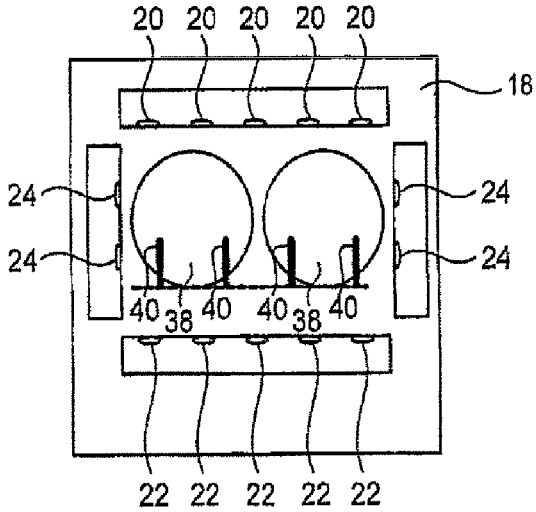
FIG. 2 is a cross-sectional view along line II-II in FIG. 1.

FIG. 2 is a cross-sectional view of the final rinse zone 18. In this embodiment, the final rinse zone 18 has downwardly directed upper spray nozzles 20, upwardly directed lower spray nozzles 22 and two transversely directed lateral spray nozzles 24 on each side of the conveyor apparatus 4. However, it goes without saying that it is also feasible to provide only upper and lower spray nozzles 20, 22 and no transversely directed lateral spray nozzles 24 in the final rinse zone 18.

Since, as indicated in FIG. 2, lateral spray nozzles 24 can also be used in the final rinse zone 18 in addition to upper and lower spray nozzles 20, 22, it is possible to spray the dish areas in shadow zones in a targeted manner too. The use of lateral spray nozzles 24 has a significant advantage in terms of the final rinse result (effective rinsing-off of detergent residues from dish surfaces in shadow zones too) over systems in which only upper and lower spray nozzles 20, 22 and no transversely directed nozzles 24 are provided in the final rinse zone 18, specifically when the conveying system is fully loaded, that is to say with plate-to-plate loading of the dish rack.

A conveyor dishwasher according to the invention is characterized in that a washware sensor apparatus 42 is provided in order to detect empty compartments 38 from amongst the large number of compartments 38 of the conveyor apparatus 4. The washware sensor apparatus 42 may have, for example, at least one camera and/or at least one optical sensor and/or at least one light barrier. The washware sensor apparatus used may also be an electromechanical sensing apparatus which is designed, for example, in the form of a screen. However, it goes without saying that other solutions can also be considered for implementing the washware sensor apparatus 42, with which solutions conclusions can be directly or indirectly drawn about the presence of empty compartments 38.

A control apparatus 44 is also provided according to the invention. The control apparatus 44 serves to automatically set the quantity of final rinse liquid which is supplied to the spray nozzles 20, 22, 24, which are associated with the final rinse zone 18, per unit time as a function of the detection of empty compartments 38.

The control apparatus 44 is specifically designed to automatically set the quantity of final rinse liquid which is supplied to the spray nozzles 20, 22, 24 of the final rinse zone 18 per unit time to a predefined or predefinable (maximum) value when the washware sensor apparatus 42 identifies that a compartment 38 which is occupied with washware 6 enters the final rinse zone 18. Secondly, the control apparatus 44 is designed in such a way that the quantity of final rinse liquid supplied to the spray nozzles 20, 22, 24 of the final rinse zone 18 per unit time is automatically set to a predefined or predefinable reduced value when the washware sensor apparatus 42 identifies that an empty compartment 38 enters the final rinse zone 18. When a compartment 38 which is occupied by washware 6 enters the final rinse zone 18, the volumetric flow of final rinse liquid is preferably set to a (maximum) value which permits conventional final rinsing with a predefined volumetric flow in the final rinse zone 18. If, in contrast, a compartment 38 which is not occupied by washware 6, that is to say an empty compartment 38, enters the final rinse zone 18, the volumetric flow of final rinse liquid should be correspondingly reduced. Accordingly—when there is an empty compartment 38 in the final rinse zone 18—only a reduced quantity of final rinse liquid is sprayed in the final rinse zone 18 per unit time. By restricting the supply of final rinse liquid to the final rinse zone 18, the supply of fresh water to the conveyor dishwasher 2 is reduced and water, chemicals and energy are saved.

In a preferred implementation of the solution according to the invention, a final rinse pump (not explicitly illustrated in the drawings) is used, it being possible to change the rotation speed of the final rinse pump, and the final rinse pump being used to reduce the quantity of final rinse liquid supplied to the final rinse zone 18 per unit time or the volumetric flow of fresh water when empty compartments 38 are detected.

As a result of empty compartments 38 being detected, a state can be identified in which a single empty compartment 38 is present between occupied compartments 38. It is also possible to detect whether a group of immediately successive empty compartments 38 is being moved in the conveying direction 8 through the conveyor dishwasher 2 by the conveyor apparatus 4 and how many empty (single) compartments 38 make up this group. The detection results of the washware sensor apparatus 42 are evaluated in this way in the control apparatus 44 for example. The result of the evaluation is preferably used by the control apparatus 44 to automatically set the quantity of final rinse liquid supplied to the spray nozzles 20, 22, 24, which are associated with the final rinse zone 18, per unit time as a function of the determined number of successive empty compartments 38.

It is accordingly feasible for the control apparatus 44 to be used to automatically set the quantity of final rinse liquid which is supplied to the spray nozzles 20, 22, 24 of the final rinse zone 18 per unit time to a predefined or predefinable maximum value when a compartment 38 which is occupied by washware 6 enters the final rinse zone 18. As already indicated above, this predefined or predefinable maximum value is preferably selected in such a way that conventional final rinsing is performed with a predefined volumetric flow in the final rinse zone 18 in a case when a compartment 38 which is occupied by washware 6 enters the final rinse zone 18.

Secondly, the quantity of final rinse liquid which is supplied to the spray nozzles 20, 22, 24 of the final rinse zone 18 per unit time should be automatically set to a predefined or predefinable reduced value by the control apparatus 44 when the evaluation of the detection results of the washware sensor apparatus 42 shows that a predefined or predefinable first number of successive empty compartments 38 enters the final rinse zone 18. If, for example, it is detected that a single empty compartment 38, which is therefore situated between two compartments 38 which are occupied by washware 6, enters the final rinse zone 18, the volumetric flow of final rinse liquid should preferably be restricted to a predefined reduced value.

It is feasible here, for example, for the control apparatus 44 to be used to further reduce the volumetric flow of the final rinse liquid when the evaluation of the detection results of the washware sensor apparatus 42 shows that a predefined or predefinable second number of successive empty compartments 38 enters the final rinse zone 18.

The control apparatus 44 is preferably designed in such a way that it firstly restricts the supply of final rinse liquid to the spray nozzles 20, 22, 24 of the final rinse zone 18 in a suitable manner when the evaluation of the detection results of the washware sensor apparatus 42 shows that a specific number of successive empty compartments 38 enters the final rinse zone 18. Secondly, it is preferred when the control apparatus 44 is designed such that it completely interrupts the supply of final rinse liquid to the spray nozzles 20, 22, 24 of the final rinse zone 18 when the evaluation of the detection results of the washware sensor apparatus 42 shows that a predefined or predefinable critical number of successive empty compartments 38 is exceeded. It is preferred that the critical number of successive empty compartments 38, starting from which the final rinsing is thus interrupted, is greater than the predefined number of successive empty compartments 38 at which the volumetric flow of the final rinse liquid is only reduced to a greater or lesser extent.

Complete interruption of the volumetric flow of final rinse liquid supplied to the final rinse zone 18 is considered particularly when the evaluation of the detection results of the washware sensor apparatus 42 shows that the group of empty compartments 38 entering the final rinse zone 18 is made up of a sufficiently large number of immediately successive empty compartments 38, so that it is possible to ensure that conventional final rinsing with a predefined volumetric flow is not required for a relatively long period of time. The critical number of immediately successive empty compartments 38 at which the supply of final rinse liquid to the final rinse zone 18 can be completely stopped depends firstly on the conveying speed at which the compartments 38 are moved through the final rinse zone 18 by the conveying apparatus 4. Secondly, this critical number depends on the pressure drop which occurs in the final rinse liquid line system when the supply of final rinse liquid to the spray nozzles 20, 22, 24 of the final rinse zone 18 is interrupted.

According to the invention, the control apparatus 44 is designed to automatically change the quantity of final rinse liquid supplied to the spray nozzles 20, 22, 24 per unit time, with this change being made as a function of the detection of empty compartments 38. As already indicated, the final rinse zone 18, which is illustrated in cross section by way of example in FIG. 2, has downwardly directed upper spray nozzles 20, upwardly directed lower spray nozzles 22 and lateral spray nozzles 24. The above-described change can be made with regard to the quantity of final rinse liquid supplied to the upper spray nozzles 20 per unit time, with regard to the quantity of final rinse liquid supplied to the lower spray nozzles 22 per unit time and/or with regard to the quantity of final rinse liquid supplied to the lateral spray nozzles 24 per unit time.

It is feasible, for example, for only the quantity of final rinse liquid which is supplied to the lateral spray nozzles 24 of the final rinse zone 18 per unit time to be changed as a function of the detection of empty compartments 38, whereas the other spray nozzles of the final rinse zone 18 (upper and lower spray nozzles 20, 22) can be fed with a constant volumetric flow of final rinse liquid.

Therefore, according to the embodiment illustrated in FIG. 4, a final rinse liquid feed line 46 to the lateral spray nozzles 24 contains, for example, a controllable valve 48 which can be controlled by the control apparatus 44. The controllable valve 48 can be used to correspondingly change the volumetric flow of final rinse liquid supplied to the lateral spray nozzles 24 in a corresponding manner. If necessary, the controllable valve 48 can also be used to completely interrupt the supply of final rinse liquid to the lateral spray nozzles 24.

However, it goes without saying that it is also feasible, as an alternative or in addition to the controllable valve 48 which is arranged in the final rinse liquid feed line 46, to provide corresponding controllable valves in a final rinse liquid feed line 50 to the upper spray nozzles 20 and/or lower spray nozzles 22 of the final rinse zone 18 in order to be able to correspondingly change or interrupt the volumetric flow of the final rinse liquid supplied to the upper and lower spray nozzles 20, 22.

The illustration according to FIG. 4 shows that the final rinse liquid feed line 46 to the lateral spray nozzles 24 is connected to a final rinse liquid feed line 50 to the upper final rinse nozzles 20 here. As an alternative, the final rinse liquid feed line 46 can be connected, for example, to a further final rinse liquid feed line or to a final rinse liquid reservoir in any other way.

Figure 3:
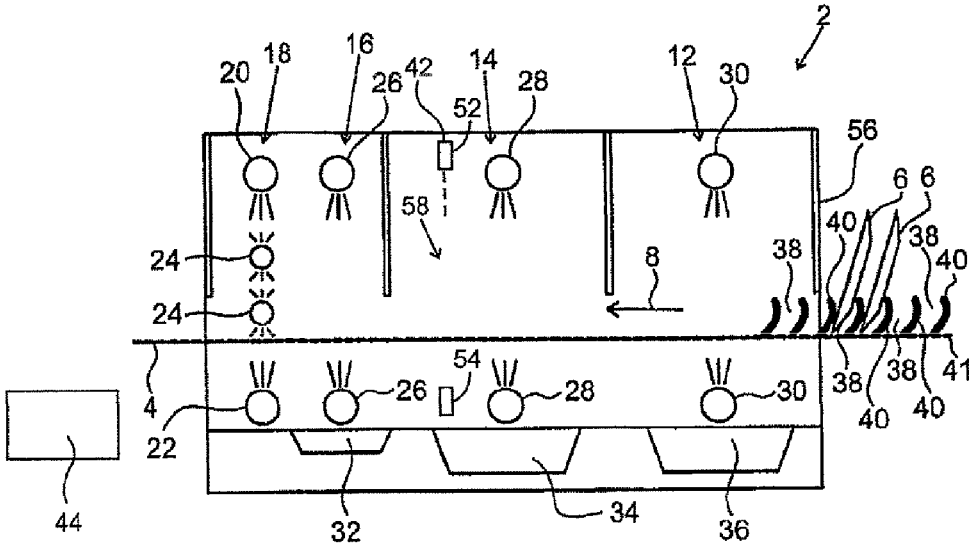
FIG. 3 shows a further embodiment of a conveyor dishwasher according to the invention.

In the embodiment of a conveyor dishwasher 2 of the invention illustrated in FIG. 3, the washware sensor apparatus 42 is arranged in the interior of the housing of the conveyor dishwasher 2 upstream of the final rinse zone 18 as seen in the conveying direction 8. In this case, the distance between the washware sensor apparatus 42 and the final rinse zone 18 is selected such that the washware sensor apparatus 42 can be used to identify not only the presence of a single empty compartment 38, but also the presence of a plurality of successive empty compartments 38. The higher the detectable number of successive empty compartments 38, the greater the distance between the washware sensor apparatus 42 and the final rinse zone 18. In this case, the control apparatus 44 is designed to change or, if required, to cut off or connect the quantity of final rinse liquid which is supplied to the spray nozzles 20, 22, 24 of the final rinse zone 18 per unit time as a function of the detected compartments 38, and in particular as a function of the number of successive empty compartments 38. The washware sensor apparatus 42 illustrated in FIG. 3 has at least one light barrier with a light transmitter 52 and a light receiver 54.

The washware sensor apparatus 42 can be arranged at a defined distance upstream of the final rinse zone 18 as seen in the conveying direction 8. As illustrated in FIG. 1, it is also feasible for the washware sensor apparatus 42 to be arranged upstream of the pre-wash zone 12 as seen in the conveying direction 8, specifically in the region of an inlet 56 of the conveyor dishwasher 2. In this case, the control apparatus 44 is designed to change the volumetric flow of final rinse liquid as a function of the detected compartments 38 when these compartments are in the final rinse zone 18.

To this end, the control apparatus 44 is designed to automatically set the quantity of final rinse liquid supplied to the spray nozzles 20, 22, 24 of the final rinse zone 18 per unit time a predetermined period of time after the detection of empty compartments 38 or after the detection of occupied compartments 38. The predetermined period of time depends on the speed of the conveyor apparatus 4 and is determined by the period of time which a compartment 38 requires in each case to move from the detection location 58 of the washware sensor apparatus 42 to the final rinse zone 18. This ensures that the quantity of final rinse liquid supplied to the spray nozzles 20, 22, 24 of the final rinse zone 18 per unit time is in each case set correctly when the relevant detected compartment 38 is located in the final rinse zone 18, irrespective of the arrangement of the washware sensor apparatus 42 relative to the final rinse zone 18.

As an alternative, provision may be made for the conveyor apparatus 4 to be designed for cyclic operation, and for the control apparatus 44 to be designed to correspondingly set the quantity of final rinse liquid supplied to the spray nozzles 20, 22, 24 of the final rinse zone 18 per unit time a predetermined number of cycle steps after the detection of empty compartments 38 or a predetermined number of cycle steps after the detection of occupied compartments 38. In this case, the predetermined number of cycle steps is determined by the number of cycle steps which a compartment 38 in each case requires to move from the detection location 58 of the washware sensor apparatus 42 to the final rinse zone 18.

The control apparatus 44 of the embodiment of a conveyor dishwasher 2 illustrated in FIG. 1 is designed to change the volumetric flow of final rinse liquid when an occupied compartment 38 enters the final rinse zone 18. For example, the control apparatus 44 can be designed to change the volumetric flow of final rinse liquid at the beginning of entry of an empty compartment 38 into the final rinse zone 18. Secondly, the control apparatus 44 can be designed to set the volumetric flow of final rinse liquid when an empty compartment 38 has fully entered the final rinse zone 18.

The illustration according to FIG. 5 shows, by way of example, possible occupation of the conveyor apparatus 4. In a first section 60 of the conveyor apparatus 4, three plates are in each case located in one compartment 38 of the conveyor apparatus 4. An empty compartment 38 is in each case located between these plates. As described above, the control device 44 can be designed such that the quantity of final rinse liquid supplied to the spray nozzles 20, 22, 24 of the final rinse zone 18 per unit time is reduced for each unoccupied, that is to say empty, compartment 38, and that the quantity of final rinse liquid supplied to the spray nozzles 20, 22, 24 of the final rinse zone 18 per unit time assumes a predefined (maximum) value when occupied compartments 38 are present. The control device 44 can also be designed such that the supply of final rinse liquid to the spray nozzles 20, 22, 24 is completely stopped when there is a specific number of successive empty compartments. Assuming that the supply of the final rinse liquid is already interrupted when there are three successive empty compartments 38, the volumetric flow of final rinse liquid to the spray nozzles 20, 22, 24 of the final rinse zone 18 is therefore changed in the order "maximum-reduced-maximum-reduced-maximum-off" given occupation as illustrated in the first section 60 of FIG. 5.

The invention is not restricted to the embodiments of FIG. 1 to FIG. 5 shown by way of example in the drawings. Rather, the invention can be gathered from an overall examination of the claims and the description of the exemplary embodiments by a person skilled in the art.

The invention claimed is:

1. Conveyor dishwasher comprising a conveyor apparatus for conveying washware through at least one wash zone and at least one final rinse zone, with the conveyor apparatus having a number of compartments for accommodating washware, with the at least one final rinse zone having spray nozzles for spraying final rinse liquid onto the washware, and with a washware sensor apparatus being provided in order to detect empty compartments from amongst the number of compartments, characterized in that a control apparatus is provided, which is designed to automatically set the quantity of final rinse liquid supplied to the spray nozzles per unit time as a function of the detection of empty compartments;

wherein the control apparatus is designed to automatically set the quantity of final rinse liquid supplied to the spray nozzles per unit time to a predefined or predefinable first value when an occupied compartment enters the at least one final rinse zone, and to automatically set the quantity of final rinse liquid supplied to the spray nozzles per unit time to a predefined or predefinable second value when an empty compartment enters the at least one final rinse zone, with the second value being greater than zero and less than the first value.

2. Conveyor dishwasher comprising a conveyor apparatus for conveying washware through at least one wash zone and at least one final rinse zone, with the conveyor apparatus having a number of compartments for accommodating washware, with the at least one final rinse zone having spray nozzles for spraying final rinse liquid onto the washware, and with a washware sensor apparatus being provided in order to detect empty compartments from amongst the number of compartments, characterized in that a control apparatus is provided, which is designed to automatically set the quantity of final rinse liquid supplied to the spray nozzles per unit time as a function of the detection of empty compartments, characterized in that the control apparatus is designed to determine the number of empty compartments in a group of successive empty compartments on the basis of the detection results of the washware sensor apparatus, and in that the control apparatus is also designed to automatically set the quantity of the final rinse liquid supplied to the spray nozzles per unit time as a function of the determined number of successive empty compartments; and characterized in that the control apparatus is designed to automatically set the quantity of final rinse liquid supplied to the spray nozzles per unit time to a predefined or predefinable first value when an occupied compartment enters the at least one final rinse zone;

to automatically set the quantity of final rinse liquid supplied to the spray nozzles per unit time to a predefined or predefinable second value when the first compartment of a predefined or predefinable first number of successive empty compartments enters the at least one final rinse zone; and to automatically interrupt the supply of final rinse liquid to the spray nozzles when the first compartment of a second number of successive empty compartments enters the at least one final rinse zone, with the second value being greater than zero and less than the first value, and with the second number of successive empty compartments being greater than the first number of successive empty compartments.

3. Conveyor dishwasher according to claim 1, characterized in that the washware sensor apparatus is arranged at a defined distance upstream of the at least one final rinse zone as seen in the conveying direction, and in that the control apparatus is designed to automatically set the quantity of final rinse liquid supplied to the spray nozzles per unit time a predetermined period of time after the detection of empty compartments or after the detection of occupied compartments.

4. Conveyor dishwasher according to claim 3, characterized in that the predetermined period of time is determined by means of the conveying speed at which the compartments are conveyed through the treatment zones of the conveyor dishwasher with the aid of the conveyor apparatus.

5. Conveyor dishwasher according to claim 3, characterized in that the conveyor apparatus is designed for cyclic operation, and in that the control apparatus is designed to correspondingly set the quantity of final rinse liquid supplied to the spray nozzles per unit time a predetermined number of cycle steps after the detection of empty compartments or a predetermined number of cycle steps after the detection of occupied compartments, with the predetermined number of cycle steps being determined by the number of cycle steps which a compartment in each case requires to move from the detection location of the washware sensor apparatus to the at least one final rinse zone.

6. Conveyor dishwasher according to claim 1, characterized in that each of the number of compartments extends transverse to the conveying direction.

7. Conveyor dishwasher according to claim 1, characterized in that the at least one final rinse zone has at least one downwardly directed upper spray nozzle and at least one upwardly directed lower spray nozzle, and in that the control apparatus is designed to automatically set the quantity of final rinse liquid supplied to the at least one upper spray nozzle per unit time as a function of the detection of empty compartments, and/or in that the control apparatus is designed to automatically set the quantity of final rinse liquid supplied to the at least one lower spray nozzle per unit time as a function of the detection of empty compartments.

8. Conveyor dishwasher according to claim 7, characterized in that the at least one final rinse zone has at least one lateral spray nozzle, and in that the control apparatus is designed to automatically set the quantity of final rinse liquid supplied to the at least one lateral spray nozzle per unit time as a function of the detection of empty compartments.

9. A conveyor dishwasher comprising a conveyor apparatus for conveying washware through at least one wash zone and at least one final rinse zone, with the conveyor apparatus having a number of compartments for accommodating washware, with the at least one final rinse zone having at least a first spray nozzle for spraying final rinse liquid onto the washware, and with a washware sensor apparatus being provided in order to detect empty compartments from amongst the number of compartments, characterized in that a control apparatus is provided, which is designed to automatically set the quantity of final rinse liquid supplied to the first spray nozzle per unit time as a function of the detection of empty compartments so that quantity of flow per unit time through the first spray nozzle is switched between at least two non-zero values.

10. A conveyor dishwasher according to claim 9, characterized in that the control apparatus is designed to determine the number of empty compartments in a group of successive empty compartments on the basis of the detection results of the washware sensor apparatus, and in that the control apparatus is also designed to automatically set the quantity of the final rinse liquid supplied to the first spray nozzle per unit time as a function of the determined number of successive empty compartments.

11. A conveyor dishwasher comprising a conveyor apparatus for conveying washware through at least one wash zone and at least one final rinse zone, with the conveyor apparatus having a number of compartments for accommodating washware, with the at least one final rinse zone having spray nozzles for spraying final rinse liquid onto the washware, and with a washware sensor apparatus being provided in order to detect empty compartments from amongst the number of compartments, characterized in that a control apparatus is provided, which is designed to automatically set the quantity of final rinse liquid supplied to the spray nozzles per unit time as a function of the detection of empty compartments so that quantity of flow per unit time through each of the spray nozzles is switched between at least two non-zero values.

12. A conveyor dishwasher according to claim 11, characterized in that the control apparatus is designed to determine the number of empty compartments in a group of successive empty compartments on the basis of the detection results of the washware sensor apparatus, and in that the control apparatus is also designed to automatically set the quantity of the final rinse liquid supplied to the spray nozzles per unit time as a function of the determined number of successive empty compartments.

13. A conveyor dishwasher according to claim 12, characterized in that the control apparatus is designed to automatically set the quantity of final rinse liquid supplied to the spray nozzles per unit time to a predefined or predefinable first value when an occupied compartment enters the at least one final rinse zone;

to automatically set the quantity of final rinse liquid supplied to the spray nozzles per unit time to a predefined or predefinable second value when the first compartment of a predefined or predefinable first number of successive empty compartments enters the at least one final rinse zone; and to automatically interrupt the supply of final rinse liquid to the spray nozzles when the first compartment of a second number of successive empty compartments enters the at least one final rinse zone, with the second value being greater than zero and less than the first value, and with the second number of successive empty compartments being greater than the first number of successive empty compartments.

14. A conveyor dishwasher according to claim 12, characterized in that the control apparatus is designed to automatically set the quantity of final rinse liquid supplied to the spray nozzles per unit time to a predefined or predefinable first value when an occupied compartment enters the at least one final rinse zone;

to automatically set the quantity of final rinse liquid supplied to the spray nozzles per unit time to a predefined or predefinable second value when the first compartment of a predefined or predefinable first number of successive empty compartments enters the at least one final rinse zone;

to automatically set the quantity of final rinse liquid supplied to the spray nozzles per unit time to a predefined or predefinable third value when the first compartment of a predefined or predefinable second number of successive empty compartments enters the at least one final rinse zone; and to automatically interrupt the supply of final rinse liquid to the spray nozzles when the first compartment of a third number of successive empty compartments enters the at least one final rinse zone, with the third value being greater than zero and less than the second value and the second value being greater than the first value, and with the third number of successive empty compartments being greater than the second number of successive empty compartments and the second number of successive empty compartments being greater than the first number of successive empty compartments.

* * * * *